United States Patent [19]

Klamar

[11] Patent Number: 4,955,756

[45] Date of Patent: Sep. 11, 1990

[54] PIPELINE PADDING SYSTEM

[76] Inventor: Ed Klamar, 320 N. 7th St., Indiana, Pa. 15701

[21] Appl. No.: 392,503

[22] Filed: Aug. 11, 1989

Related U.S. Application Data

[63] Continuation-in-part of Ser. No. 200,743, May 31, 1988.

[51] Int. Cl.[5] ..... E02F 5/22

[52] U.S. Cl. ..... 405/179; 37/142.5

[58] Field of Search ..... 405/179; 37/142.5, 96, 37/101, 107, 89, 8; 171/16; 209/421, 260

[56] References Cited

U.S. PATENT DOCUMENTS

| | | | |
|---|---|---|---|
| 3,322,354 | 5/1967 | Ostermann et al. . | |
| 3,670,972 | 6/1972 | Quinn . | |
| 3,701,422 | 10/1972 | Downey | 37/142.5 X |
| 3,704,834 | 12/1972 | Nilsson et al. . | |
| 3,874,182 | 4/1975 | Potter et al. | 405/179 |
| 4,530,403 | 7/1985 | Theurer et al. | 37/107 X |
| 4,633,602 | 1/1987 | Layh et al. | 37/142.5 X |
| 4,635,664 | 1/1987 | Theurer et al. | 37/107 X |
| 4,664,791 | 5/1987 | McClain et al. | 405/179 X |
| 4,669,674 | 6/1987 | Oldengott et al. . | |
| 4,799,430 | 1/1989 | Theurer | 37/107 X |
| 4,812,078 | 3/1989 | Rivard | 405/179 |
| 4,861,461 | 8/1989 | Utterback | 37/142.5 X |

*Primary Examiner*—Dennis L. Taylor
*Assistant Examiner*—J. Russell McBee
*Attorney, Agent, or Firm*—Buchanan Ingersoll

[57] ABSTRACT

Backfilling apparatus adapted to be moved along a trench by a tractor includes a chassis, a hitch attachable to the chassis on either side, hydraulic cylinder for varying the attitude of the chassis to the hitch, a hopper mounted on the chassis to receive backfilling material, a variable speed conveyor carrying backfilling material from the hopper to an elevated position, a shredder accepting material from the conveyor, an inclined vibrating screen receiving shredded material and discharging padding fill onto the pipe in the trench and oversize material onto the padding fill in the trench. A grizzly at the hopper mouth can be positioned to discharge large masses of fill on either side or the rear of the chassis.

9 Claims, 4 Drawing Sheets

PIPELINE PADDING SYSTEM

REFERENCE TO RELATED APPLICATION

This is a continuation-in-part of my U.S. patent application Ser. No. 200,743, now pending filed 5/3/88.

This invention relates to apparatus for backfilling a pipeline laid in a trench. It is more particularly concerned with such apparatus which can be moved along a trench by a carrier vehicle and which accepts unclassified fill and deposits it on the pipe in layers; finer fill, referred to as "padding", directly in contact with the pipe, and coarser material, in layers of ascending larger size thereon.

BACKGROUND OF THE INVENTION

It is well known to cantilever backfilling apparatus over a pipeline trench from a crawler type tractor or the like which travels parallel to the trench.

A recent patent for such apparatus is that of McClain et al. U.S. Pat. No. 4,664,791 of May 12, 1987. The apparatus theredescribed has a chute into which is loaded backfill, such as material previously removed from the trench. The material is dropped in batches onto a vibrating screen; the size which passes through the screen is deposited on the pipe within the trench and the material of the batch which does not pass through the screen is mixed with the following batch; accumulating oversize is disposed of from time to time by dumping it away from the trench. The prior art patents cited against McClain et al., which are listed on the patent, disclose other more or less similar devices designed for like purposes.

Apparatus of that type must be loaded by a bucket elevator or the like which charges successive bucketfuls of backfill into the chute. Each load falls as a batch onto the screen, blocking or overloading it until an appreciable fraction has been disposed of by the screening action. If the chute has a grizzly at its discharge end, the operation of the apparatus must be stopped periodically until the oversized material is removed. If the pipeline is laid up and down hills, as not infrequently happens, the delivery of padding material from the screen may vary substantially between uphill and downhill travel.

SUMMARY OF THE INVENTION

The apparatus of my invention is carried by a crawler tractor or like vehicle in somewhat the same way as that of McClain. The apparatus of my invention is contained in a frame or chassis which is pivotally cantilevered on a hitch affixed to the crawler tractor and which allows the hitch to be positioned on either side of the trench. A hydraulic cylinder varies the attitude of my chassis, that is, the angle between the chassis and the hitch. My machine embodies a hopper fixed in the chassis into which unclassified backfill material is loaded. The hopper mouth is provided with grizzly bars which deflect the large rock and masses of clay fill not readily broken up. The grizzly is hinged to a frame which can be attached to the hopper at its mouth. In one embodiment the hopper mouth is as wide as it is long so that the grizzly, by proper positioning, may optionally be inclined toward the rear of my apparatus, or to either side. A variable speed conveyor conveys fill material from the bottom of the hopper to a higher elevation where it is discharged through a shredder onto a downwardly inclined vibrating screen. The speed of the conveyor and the attitude of my machine are varied by the operator to maintain a uniform flow of backfill onto the vibrating screen. The shredder is a rotary device which beats the fill material with flails, breaking up larger lumps into smaller lumps. The screen is preferably double-decked. Fine material of padding size falls through both screens and into the trench in front of my chassis onto the pipe. Pieces which pass through the upper screen, which screen has a coarser mesh than the lower screen, but not the lower screen, travel over the lower screen into a chute and are directed rearwardly thereby into the trench onto the padding fill. Pieces too large to fall through the upper screen may travel over that screen into another chute, if desired, which directs them into the trench onto the layer of fill from the lower screen. A further chute may also be provided to receive large pieces of fill which will not pass through the grizzly on the hopper and direct them rearwardly into the trench or otherwise as desired. My apparatus, as above-described, forms a uniform padding layered classified fill from unclassified fill material.

DESCRIPTION OF PREFERRED EMBODIMENT

Figure 1:
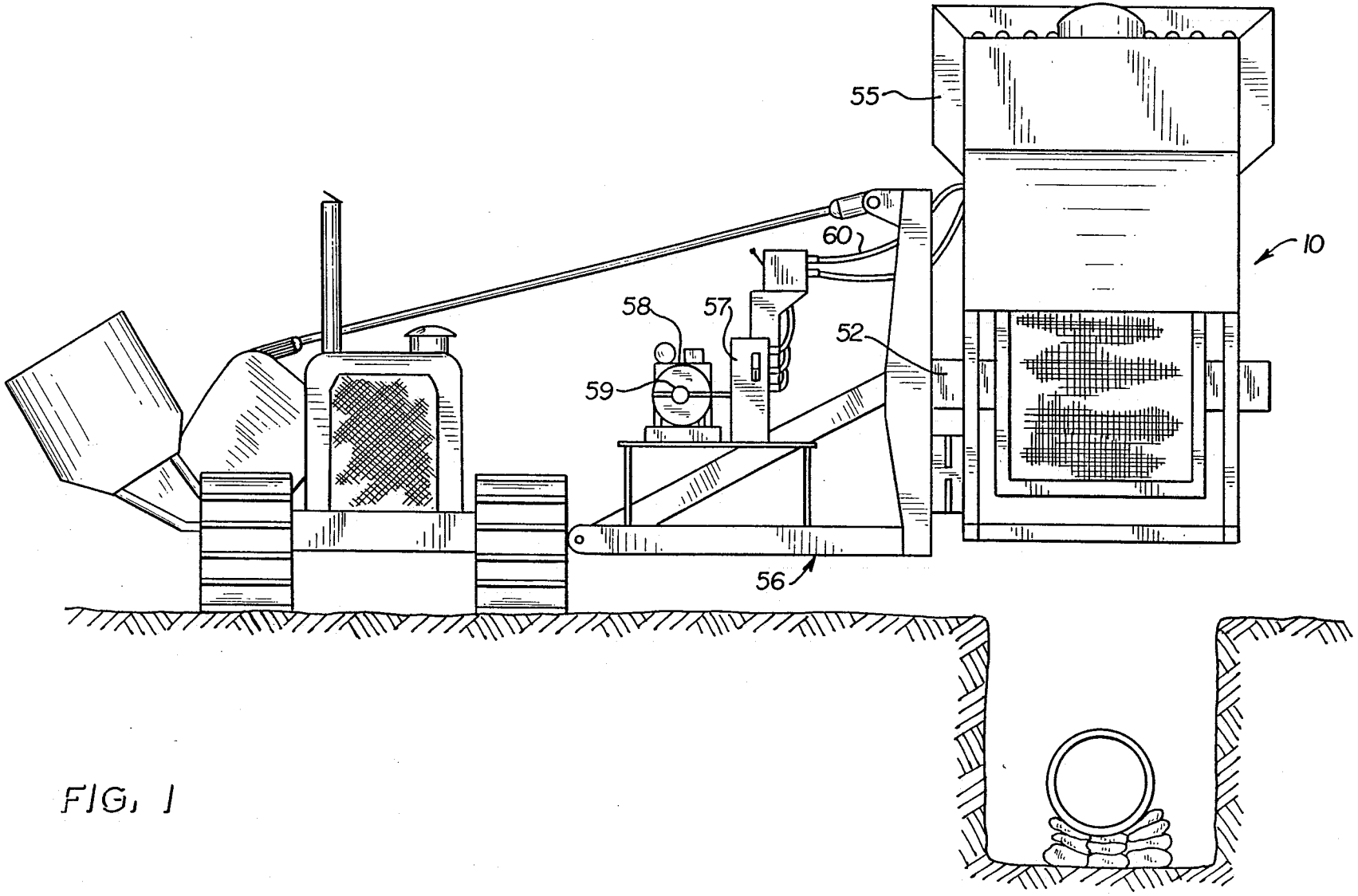
FIG. 1 is a front end elevation of a first embodiment of my apparatus mounted on a carrying vehicle.

As it is shown in the figures, my apparatus is mounted in a chassis 10 comprising two identical side frames 11, each having a top rail 12, a vertical rear end rail 13, vertical front end rail 14, bottom rails 15, 16 and 17 and intermediate braces 18 extending from each end of bottom rail 16 to top rail 12. In my first embodiment a fixed position hopper 19 is mounted between side frames 11, having a mouth 20 parallel to rails 12 fitted with a grizzly 21. The grizzly 21 is pivotally mounted on the rear edge of mouth 20 and inclined thereto so that oversize material which does not fall through the grizzly rolls off the grizzly to the rear of my hopper 19. Any fill remaining on the grizzly is discharged by tilting it. Below hopper 19 is a frame 23 affixed to side frames 11 and inclined upwardly from rear 13 to front 14 supporting a belt conveyor 24 which passes around front end roll 25 and rear end roll 26 and is carried over intermediate rolls 27, all of which rolls are carried by frame 23. Conveyor 24 forms the bottom of hopper 19. Conveyor 24 is driven by motor 29 coupled to roll 25. Below the conveyor 24 and extending forward to roll 25 is a vibrating screen 30 mounted on chassis element 31 which is pivotally affixed in rails 15 at its front end. A telescoping brace 33 suspends the rear end of vibrating screen 30 from conveyor frame 23 so that by adjusting the length of brace 33 the inclination of screen 30 may be adjusted. Below roll 25 of conveyor 24 at the front end of vibrating screen 30 is mounted a rotating shredder 34, details of which are shown in FIGS. 4 and 5, driven by a motor 35.

Figure 4:
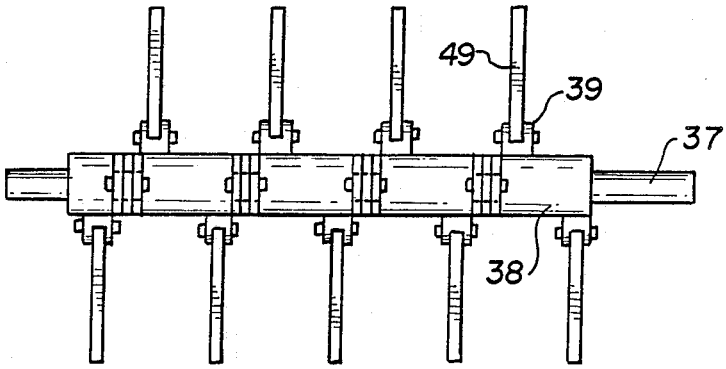
FIGS. 4 and 5 are details of the shredder shown in FIG. 2.
Figure 5:
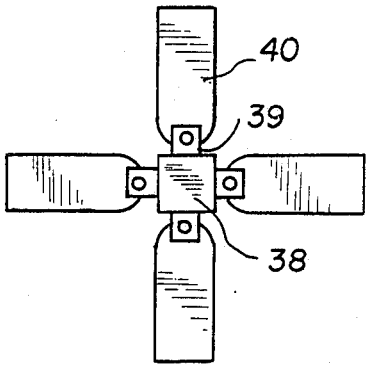

The operating member of shredder 34, as shown in FIG. 4, is the shaft 37 which is mounted in suitable bearings and is driven by motor 35. The central portion 38 of shaft 37 is flat-sided and in clevises 39 affixed to those flat sides are mounted rows of flails 40, either fixed or pivoted, as are shown in FIGS. 4 and 5.

Vibrating screen 30 is double-decked, having an upper deck screen 42 with larger apertures than its lower deck screen 43. Screens 42 and 43 are vibrated by motor 44. The small size material which passes through screen 43 falls directly onto the pipe in the trench. The material passing over screen 43 is delivered into rearwardly inclined chute 48 which directs it onto the padding materials on the pipe. The material which passes through screen 42 falls on the screen 43. The material which passes over screen 42 also exits in rearwardly inclined chute 48 or, if desired, into a second chute, not shown, and is delivered therefrom onto the previously deposited fill material above mentioned. The large pieces which pass over the grizzly 20 of hopper 19, when the grizzly is positioned on the hopper as is shown in FIG. 3, fall from its lower edge into rearwardly inclined chute 50 and complete filling of the trench. It may be desirable to fit a short discharge chute 54, in FIG. 3, to a lower edge of the mouth of grizzly 20 so as to insure that the discharge material from that grizzly falls into chute 50 above mentioned, or to the sides of the trench, and to fit outwardly flared panels or wings 55, shown in FIGS. 1, 2, and 3, to the edges of the grizzly mouth to funnel incoming fill into the grizzly.

Figure 6:
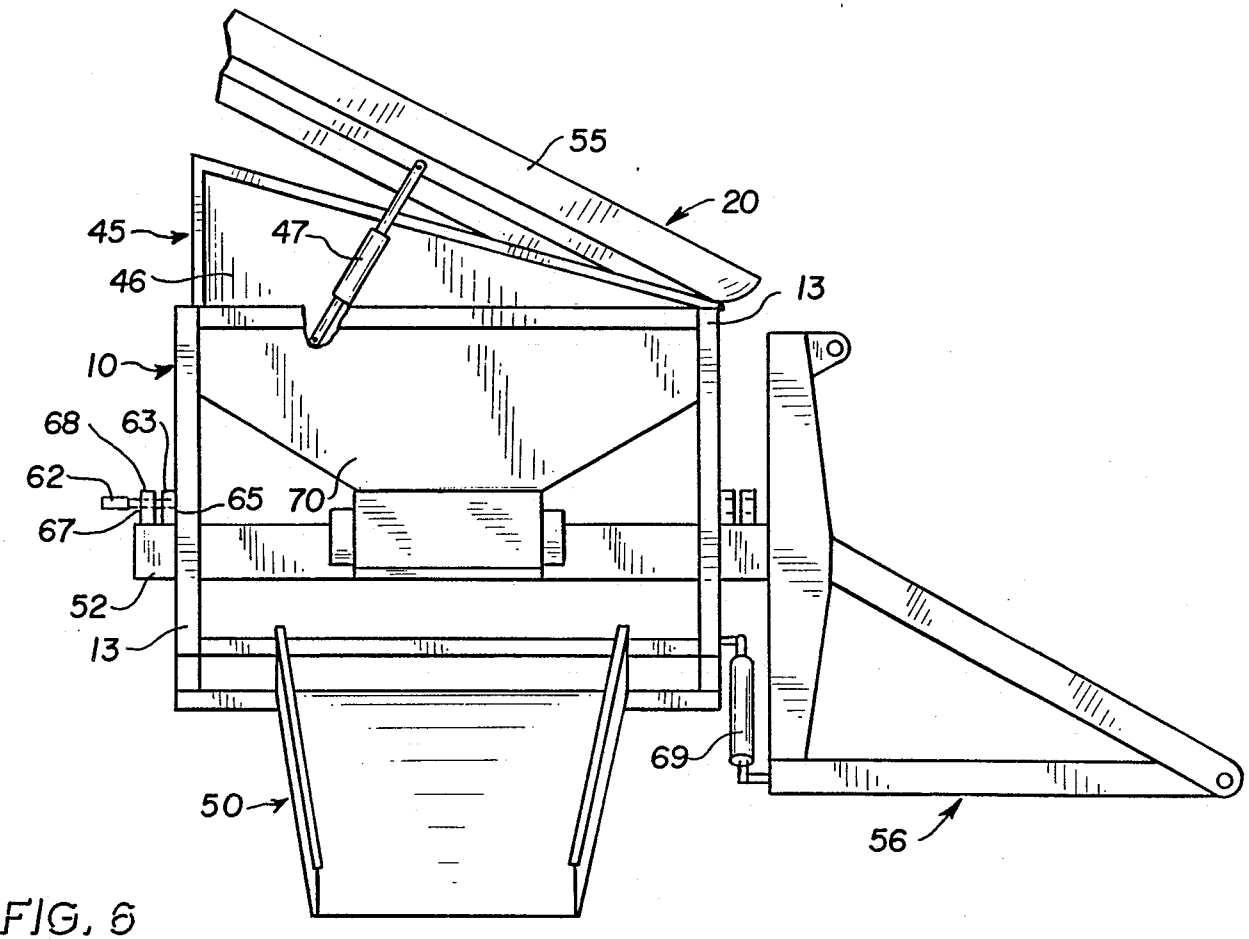
FIG. 6 is a rear elevation of a second embodiment of my apparatus.

Alternatively, as is shown in FIG. 6, grizzly 20 may be adjusted to dispose of the grizzly oversize on either side of the trench.

My invention includes the transverse support bar 52, shown in FIGS. 1, 2, 3, and 6, which is part of hitch 56 fitted to a crawler tractor or the like. Essentially hitch 56 is of the type shown in U.S. Pat. No. 4,664,791 mentioned. The motors of my apparatus are preferably hydraulic. Hitch 56 carries a hydraulic oil tank 57, a diesel engine 58, and a multi-stage pump 59 which supplies oil to the previously described motors of my apparatus through hydraulic hoses 60, and controls 61.

A hydraulic cylinder 69 is attached at one end to frame 11 through member 62 and at the other to hitch 56, FIG. 3. Cylinder 69 is supplied with oil from variable volume pump 59 through hose 60 and can be operated to adjust the angle of attitude of chassis 10, that is, between chassis 10 and hitch 56, in accordance with the slope of the ground.

Chassis 10 is pivotally mounted on transverse support bar 52 by a lug 63 on each side affixed to cross members 64 between vertical braces 18. The lugs have aligned holes 65. Transverse support bar 52 of hitch 56 also has upstanding lugs 67 spaced apart the width of chassis 10 provided with aligned holes 68, FIG. 6. Chassis 10 is mounted on support bar 52 by inserting pins 62 through each pair of mating holes 65 and 68 so that the chassis pivots on those pins. Support bar 52 may be inserted through chassis 10 from either side, permitting the carrying vehicle to be positioned on either side of the trench.

Figure 2:
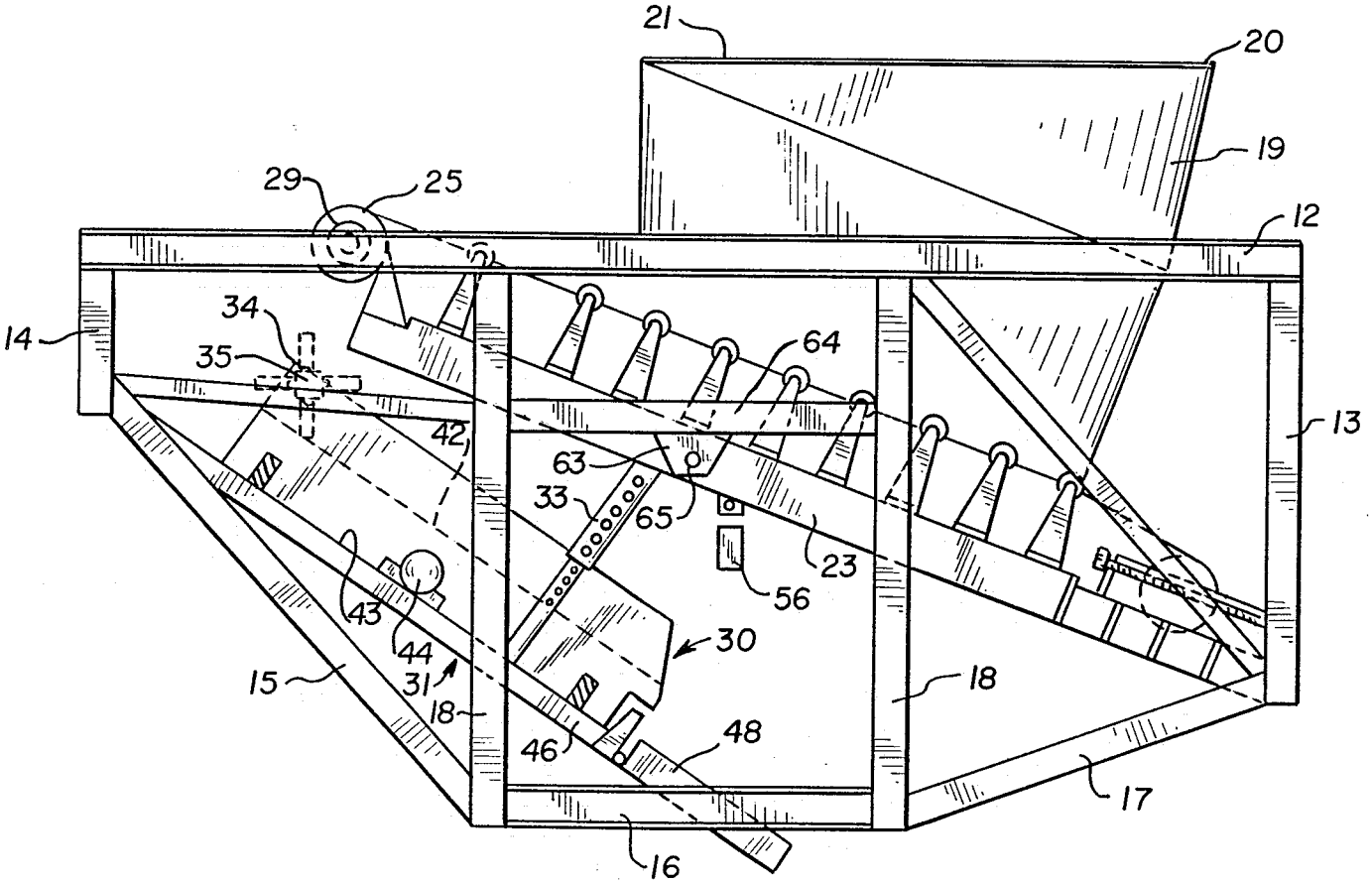
FIG. 2 is a side elevation of the chassis of my apparatus of FIG. 1 removed from its carrying vehicle, taken parallel to the trench.
Figure 3:
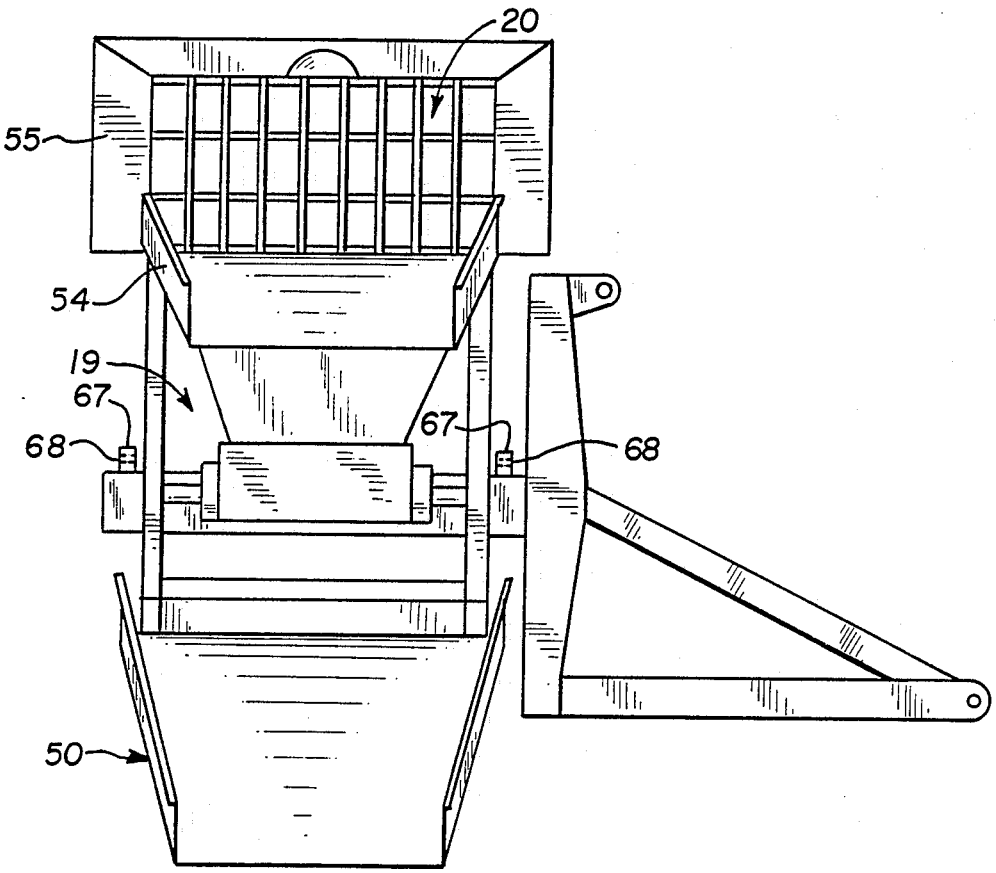
FIG. 3 is a rear elevation of my apparatus, as shown in FIG. 2, together with a portion of the carrying frame shown in FIG. 1.

In a second embodiment of my invention, shown in FIG. 6, chassis 10 is identical with its illustration in FIG. 2 except that the mouth of hopper 70 is made as wide as it is long. Grizzly 20 is hinged at one side of the hopper to a frame 45 which has a square bottom mating with the mouth of hopper 70 but may have a pair of triangular parallel sides 46. The grizzly is hinged so that it is sloped when it is resting on frame 45. A hydraulic cylinder 47 is attached on each side between chassis 10 and grizzly 20 to raise and lower the grizzly. Frame 46 is detachably mounted on the mouth of hopper 70 and may be positioned to cause grizzly 20, when it is elevated by cylinder 47, to discharge alternatively on either side of chassis 10 or to the rear thereof. This structure, in addition to the structure which allows the carrier vehicle to support the chassis from either side, considerably increases the versatility of my machine.

In the operation of my machine the backfill material is loaded into the hopper 70 by conventional means. Material at the bottom of the hopper falls onto belt conveyor 24 which is operated to move material uphill from hopper 70. The rate at which material is so moved is affected by the speed of the conveyor and the attitude, or the inclination, of chassis 10, both of which factors are controlled by the operator of the machine through controls 61. The operator can thus cause my machine to maintain an even flow of backfill material to screen 30 or an even flow of padding material from backfill which varies in consistency.

I claim:

1. Apparatus for covering pipe laid in a trench comprising an elongated chassis adapted to be mounted on carriage means movable along the trench, a backfill hopper supported by said chassis at one end, a conveyor adapted to carry backfill from said hopper discharge to an elevation above said hopper discharge at the other end of the chassis, a vibrating screen receiving backfill material discharged from said conveyor and delivering backfill material of padding size at said other end of said chassis to said pipe in said trench, a hitch attachable to said carriage means, said chassis being pivotally mounted midway of its length on said hitch for cantilevering said chassis over a trench, an auxiliary power source mounted on said hitch for said conveyor and said screen, means for varying the attitude of said chassis about said pivot mounting during movement of said chassis along said trench, and means for varying the speed of said conveyor, whereby backfill from said hopper is delivered to said pipe in said trench at a uniform rate during said movement of said chassis along said trench.

2. Apparatus of claim 1 in which said conveyor forms the bottom of said backfill hopper.

3. Apparatus of claim 1 in which said vibrating screen is the lower deck of a double-deck vibrating screen and including a discharge chute discharging the backfill material from the upper deck of said vibrating screen into the trench on top of the padding material thereon.

4. Apparatus of claim 1 including shredding means positioned between the discharge end of said conveyor and said vibrating screen.

5. Apparatus of claim 1 in which said vibrating screen is positioned at an angle to the horizontal and including means to adjust said angle.

6. Apparatus of claim 1 in which the means for varying the attitude of said chassis are power means.

7. Apparatus of claim 1 including attaching means on each side of said chassis and attaching means mating therewith on said hitch for pivotally mounting said chassis with respect to said hitch on either side of said chassis,

8. Apparatus of claim 1 in which said hopper and said vibrating means are mounted at opposite ends of said chassis and including a grizzley hinged to a grizzley frame attachable to the mouth of said hopper.

9. Apparatus of claim 8 in which said hopper mouth and said grizzley frame are square and said frame is detachable so that said grizzley can be positioned on said hopper mouth to deflect oversize backfill to either side or to an end of said chassis.

* * * * *

UNITED STATES PATENT AND TRADEMARK OFFICE

CERTIFICATE OF CORRECTION

PATENT NO. : 4,955,756

DATED : September 11, 1990

INVENTOR(S) : ED KLAMAR

It is certified that error appears in the above-identified patent and that said Letters Patent is hereby corrected as shown below:

Column 1, line 6, change "5/3/88" to --5/31/88--.

Column 4, line 46, change "thereon" to --therein--.

Column 4, line 60, change "means" to --screen--.

Signed and Sealed this

Tenth Day of December, 1991

*Attest:*

HARRY F. MANBECK, JR.

*Attesting Officer*

*Commissioner of Patents and Trademarks*